US007971618B2

(12) United States Patent
Rolion et al.

(10) Patent No.: US 7,971,618 B2
(45) Date of Patent: Jul. 5, 2011

(54) TAPE DISPENSER WITH PROTECTOR

(75) Inventors: Franck Rolion, Beloy en France (FR); Franck Vadenne, Bezons (FR)

(73) Assignee: Societe BIC, Clichy Cedex (FR)

( * ) Notice: Subject to any disclaimer, the term of this patent is extended or adjusted under 35 U.S.C. 154(b) by 71 days.

(21) Appl. No.: 12/160,075

(22) PCT Filed: Dec. 12, 2006

(86) PCT No.: PCT/EP2006/011951

§ 371 (c)(1),
(2), (4) Date: Jul. 3, 2008

(87) PCT Pub. No.: WO2007/076919

PCT Pub. Date: Jul. 12, 2007

(65) Prior Publication Data

US 2008/0308237 A1 Dec. 18, 2008

(30) Foreign Application Priority Data

Jan. 4, 2006 (EP) ..... 06000115

(51) Int. Cl.
*B65H 35/00* (2006.01)

(52) U.S. Cl. ..... 156/540; 156/238; 156/523; 156/527; 156/538; 156/547; 156/574; 156/577; 156/579; 118/76; 118/200; 118/257; 242/160.2; 242/160.4; 242/170; 242/171; 242/538.1; 242/538.3; 242/588; 242/588.2; 242/588.3; 242/588.6

(58) Field of Classification Search ..... 156/238, 156/538, 523, 527, 540, 547, 574, 577, 579; 118/76, 200, 257; 242/160.2, 160.4, 170, 242/171, 538.1, 538.3, 588, 588.2, 588.3, 242/588.6

See application file for complete search history.

(56) References Cited

U.S. PATENT DOCUMENTS 5,150,851 A * 9/1992 Manusch et al. ..... 242/599.4
5,346,580 A * 9/1994 Elges et al. ..... 156/540
5,679,156 A * 10/1997 Matsumaru ..... 118/200
6,321,815 B1 * 11/2001 You ..... 156/577

FOREIGN PATENT DOCUMENTS

JP 2002127682 A * 5/2002

* cited by examiner

*Primary Examiner* — Kat Wyrozebski
*Assistant Examiner* — Joshel Rivera
(74) *Attorney, Agent, or Firm* — Jones Day

(57) ABSTRACT

A hand-held device for transferring a film of material from a backing tape onto a substrate that includes a housing having a first housing member and a second housing member, as well as an application member around which the tape is guided and which is designed to be pressed against a substrate in order to transfer the film. The first and second housing member are mounted telescopically with each other such that in an extended position one of the housing members cover the application member and in a pushed-back position the application member is exposed for usage.

21 Claims, 3 Drawing Sheets

TAPE DISPENSER WITH PROTECTOR

CROSS-REFERENCE TO RELATED APPLICATIONS

This application is a national stage application of International Application No. PCT/EP2006/011951, filed on Dec. 12, 2006, which claims priority to European Patent Application No. 06 000 115.3 filed on Jan. 4, 2006, the entire contents of both applications being incorporated herein by reference.

BACKGROUND OF INVENTION

1. Field of Invention

The embodiments of the present invention relate to a hand-held device for transferring a film of adhesive, covering or colored material from a backing tape onto a substrate and to a replaceable cartridge for refilling a hand-held device with a backing tape on which a film of adhesive, covering or colored material is applied.

2. Description of the Related Art

Hand-held devices for transferring a film of adhesive or a correction tape or the like onto a substrate are known from prior art. Usually, such a hand-held device comprises a housing constituted of an upper housing body and a lower housing body, which are fixedly connected to each other to form the housing. Inside the housing there is provided a driving mechanism for the unused tape to be supplied to an application member protruding through an opening at a front end of the housing and for the used tape to be automatically wound onto another reel. However, after using up the correction tape or the like, the entire hand-held device has to be thrown away and cannot be reused anymore, which is quite a waste. Since the upper and the lower body are connected to each other fixedly after the interior components are fixed, it is not possible to reopen the housing for refilling the tape after it is used. Moreover, even if the housing would be re-openable, for a user it would not be easily possible to fix a new roll of correction tape or adhesive tape or the like onto the reels provided in the interior of the housing or on the inner walls, respectively, since the components are very small and the mounting would have to be carried out very precisely. Moreover, these tapes are very sensitive, so that placing a roll of tape on the reels such that the tape is guided along the correct path within the interior of the housing, would most probably end up in the tape being ruptured. Thus, every time the tape contained in a hand-held device is used up, the entire hand-held device has to be thrown away, rendering it very expensive. Moreover, a hand-held device can only be used for one type of tape, like, e.g., correction tape. For the use of another kind of tape, like, e.g., an adhesive tape, another hand-held device has to be bought by a user.

Another problem occurring with hand-held devices known from prior art is that the tip of the application member carrying the tape always protrudes from the housing, even when the hand-held device is not used, such that the very sensitive tape is always exposed to exterior influences and thus, can easily be injured or ruptured.

Therefore, an embodiment of the present invention is based on the object to provide a hand-held device, which is reusable or refillable, respectively, with a tape of any kind, wherein the replacement of the used tape by a new tape is very easy and uncomplicated for a user, and wherein the application member is protected from outer influences when the hand-held device is not being used.

This object is solved by a hand-held device having the features described below, and a replaceable cartridge to be used with the hand-held device having the features described below.

SUMMARY OF THE INVENTION

According to the embodiments of the invention, a hand-held device for transferring a film of adhesive, covering or colored material from a backing tape onto a substrate is provided, comprising a housing and a replaceable cartridge, wherein the housing is composed of a first housing member and a second housing member, the first housing being provided with a tip opening at a front end of the hand-held device, and the second housing member being provided with rear opening and a flap at a rear end of the hand-held device, the flap being adapted to swing around an axis of a hinge from a closed position, in which it covers the rear opening, to an open position in which it uncovers the rear opening.

Since the flap is provided on the rear end of the hand-held device or of the second housing member, respectively, the latter can be opened to take out a used cartridge and to replace it by a new one. Moreover, the housing could be used for replacement by a cartridge carrying another type of tape, such that the hand-held device could be employed, for example, as a correction tape applicator or alternatively as an adhesive tape applicator, when the cartridge is replaced accordingly. Thus, the housing of a hand-held device can be used many times and does not have to be thrown away after a roll of tape is used up. The replacement of only the cartridge with the tape is less expensive and produces less waste.

Moreover, the housing is composed of a first housing member and a second housing member. The two members are connected to each other telescopically, and the first housing member and the second housing member can be moved relative to each other along a longitudinal axis of the hand-held device. Thus, in a first position, when the second member is totally inserted into the first housing member, the tip of the application member protrudes through the tip opening provided in the first housing member, such that the hand-held device can be used to apply a film of a correction tape or the like onto a substrate. When the hand-held device is not used, the second housing member with the cartridge supported therein, is shifted backwards to a second position in which it extends from the first housing member, and automatically, the tip of the application member is retracted into the housing, and, thus, is protected from exterior influences.

The flap due to its shape and its locking mechanism reliably closes the rear opening of the second housing member so that the cartridge is kept in the interior of the housing until it has to be replaced by a user. Then, the flap can be easily opened in that it swings around a hinge provided at the second housing member and uncovers the rear opening so that the cartridge can be taken out and be replaced by a new one. Thus, a simple and effective reusable system is provided according to an embodiment of the present invention.

Further according to an embodiment of the present invention, a replaceable cartridge for refilling a hand-held device with a backing tape on which a film of adhesive, covering or colored material is applied, is provided, comprising a housing provided with an opening through which an application member, around which the tape is wound, protrudes, and a driving mechanism. The inventive replaceable cartridge has a compact design and is easy to replace in the hand-held device. Moreover, it comprises all components inside, i.e. the driving mechanism for the tape to be supplied and taken up again as well as an application member for applying the tape onto a substrate. Thus, the exchange or replacement, respectively, of the cartridge is very easy.

BRIEF DESCRIPTION OF THE DRAWINGS

The embodiments of the present invention and further advantages, which can be achieved by the present invention, will now be explained in detail by means of a preferred embodiment with reference to the drawings in which

FIG. 1 shows a side view of the hand-held device 1 according to the present invention in which the first housing member 2 and the second housing member 3 are in a first position, in which the tip 4 of the application member 5 protrudes through a tip opening 6 formed in the front end 7 of the hand-held device 1. In this position, the second housing member 3 and the first housing member 2 are pushed together as far as possible.

In this regard, the first and second housing member are attached to each other such that they can be displaced with respect to each other in a telescopic manner.

Figure 3:
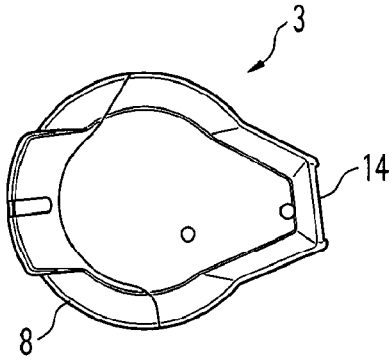
FIG. 3 shows a side view of the second housing member with the flap closed.

The first housing member 2 is adapted to protect, in the projected position as shown in FIG. 3, the application tip 4.

Figure 1:
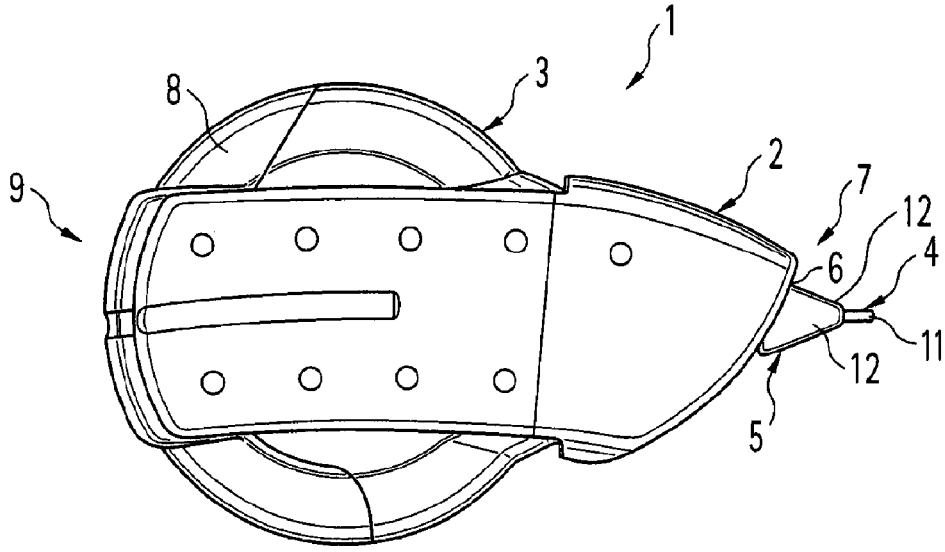
FIG. 1 shows a side view of the hand-held device according to an embodiment of the present invention with the first housing member and the second housing member in the first position.

In the pushed-back position of FIG. 1 the tip 4 is exposed and can thus be used to apply a tape against a substrate. In the pushed-back position the first housing member 2 overlaps the second housing member in a substantial amount, preferably more than 50% of the length of the second housing member. In the shown example it is preferred that the supply reel and the take-up reel for the tape are arranged coaxially with each other. In this case the first housing member may be arranged to overlap the second housing member rearwards up to the common axis of the reels when being in the pushed back position of FIG. 1. (The coaxial arrangement of the reels of a correction tape application device as such is known from the prior art.)

Preferably the first housing member overlaps the second housing member at least up to the bearing axis of the reels. Preferably the rear end of the first housing member overlaps the contour of at least one reel, when seen in a side view. This also applies to designs where the two reels are not arranged in a coaxial manner, but where the axes of the reels are distanced from each other. In this case preferably the rear end of the first housing member overlaps at least a part of the contour of the front reel, when seen in a side view.

Due to the long rearwards extension of the first housing member, the first housing member is designed to be held by the fingers of the user when applying a tape on a substrate.

The second housing member, in the interior of which the two reels are mounted, can have the shape of a disc when seen from the side. The rear end of the first housing member overlaps at least partially this disc part of the second housing member.

The rear end of the first housing member preferably only covers the side walls of the second housing member, but not the top wall and the bottom wall (which is the one directed to the substrate when operating the device).

The front end of the first housing member is designed to entirely enclose the application tip 4.

Figure 2:
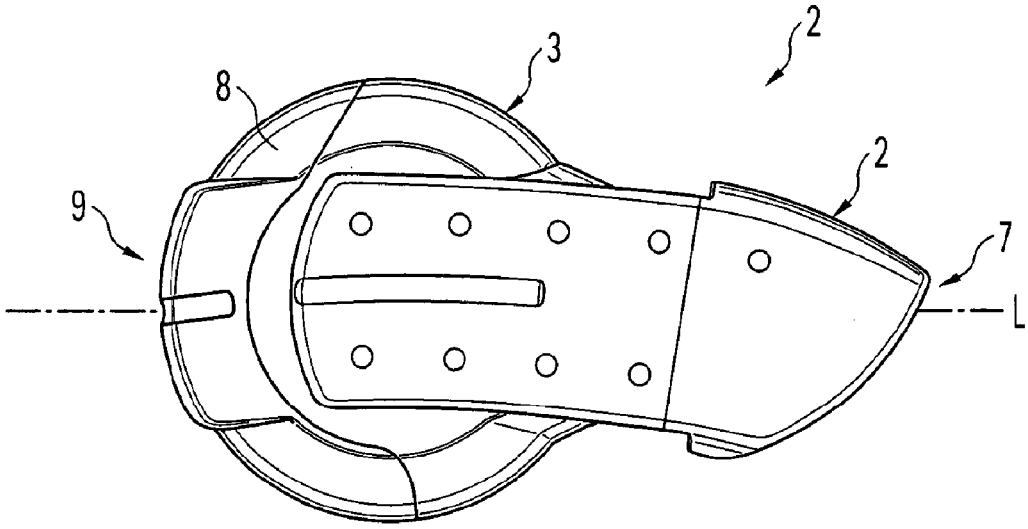
FIG. 2 shows a side view of the hand-held device according to an embodiment of the present invention with the first housing member and the second housing member in the second position.

In the extended position of the first and the second member, shown in FIG. 2, the tip 4 is no longer exposed, but protected.

A flap 8 is provided at a rear end 9 of the hand-held device 1 covering a rear opening 10 provided in the rear end of the second housing member 3. The shape of the flap 8 is semicircular and conforms to the shape of the second housing member 3.

When the first housing member 2 and the second housing member 3 are in this position, i.e. the pushed-back first position, the hand-held device 1 is ready to be used, since the tip 4 of the application member 5 protrudes from the housing. The tip 4 of the application member 5 has an application edge 11 around which the backing tape covered with a film of, e.g., correction material is guided between two opposite guiding wings 12. The application member 5 is a part of the cartridge 13 which is arranged in a cavity formed within the first housing member 2 and the second housing member 3, whereby the cartridge 13 is supported only in the second housing member 2.

When the hand-held device 1 is used by a user to apply a tape, like a correction or adhesive tape, onto a substrate, the user holds the hand-held device 1 with his fingers positioned on the outer surface of the first housing member 2. Therefore, depressions can be provided on each of side of the outer surface of the first housing member 2, into which the user can put his fingers to not slip off when using the hand-held device 1. Alternatively or also additionally, riffles in the form of, e.g., grip ribs can be provided on the outer surface of the first housing member 2. The first housing member 2 and the second housing member 3 can be connected to each other by any convenient means which still permits them to be telescoped. For example, they can be connected to each other by form fitting.

FIG. 2 shows a side view of the hand-held device 1 according to an embodiment of the present invention with the first housing member 2 and the second housing member 3 in the second (extended) position, whereby in this position the second housing member 3 is extended from the first housing member 2. After the user finishes using the hand-held device 1, he can simply pull the second housing member 3 back substantially in the direction of a longitudinal axis L of the hand-held device 2, such that the second housing member 3 is extended, and, thus, the entire hand-held device 1 is elongated.

Note that this telescopic arrangement of the first and the second housing member can be used both with dispensers of the cartridge type and of the non-cartridge type.

Since the application member 5 is only supported in the second housing member 3, it is also drawn back by this action together with the second housing member 3. The second position is reached, when the entire application member 5 disappears in the cavity formed within the two housings members.

In this position, the tip 4 and, thus, the tape 34 guided around the tip 4, is protected from outer influences and the hand-held device 1 can be safely stored without injuring or rupturing the tape 34.

FIG. 3 shows a side view of the second housing member 3 without a cartridge 13 inserted and with the flap 8 closed. The second housing member 3 also has a tip opening 14 through which, when a cartridge 13 is inserted, the tip 4 of the application member 5 projects. When the flap 8 is in the closed position, it covers the rear opening 10 of the second housing member 3 such that a cartridge 13 would reliably stay inside the cavity of the second housing member 3. Moreover, when the flap 8 is in the closed position the shape of the flap 8 being semicircular nearly forms together with a portion of the second housing member 3 a circle.

Figure 4:
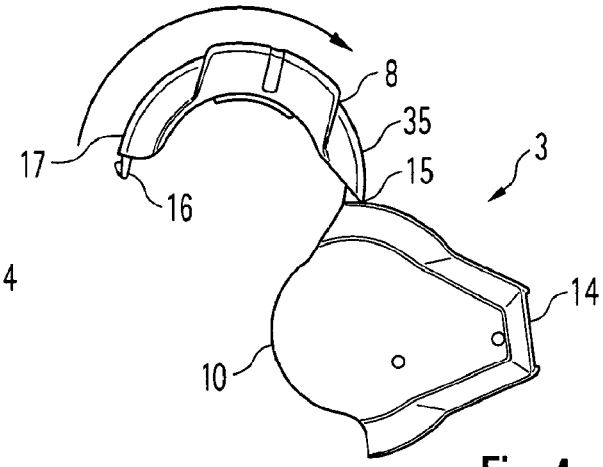
FIG. 4 shows a side view of the second housing member with the flap opened.

FIG. 4 shows a side view of the second housing member 3 without a cartridge 13 inserted and with the flap 8 opened. Here, the flap 8 is in the opened position, whereby it is rotated around a hinge 15 to which the flap 8 having a first end 35 and a second end 17, is connected to the second housing member 3 with its first end 35. In this position, the rear opening 10 provided in the rear part of the second housing member 3 is uncovered such that a cartridge 13 can be inserted into the cavity formed in the interior of the second housing member 3. The size of the rear opening 10 is slightly larger than the cartridge 13 itself so that the latter can be easily inserted. After insertion of the cartridge 13, the flap 8 has to be rotated back to cover the rear opening 10. Moreover, when the flap 8 reaches the first position in which it covers the rear opening 10, it is locked in this position by a locking mechanism 16.

Figure 5:
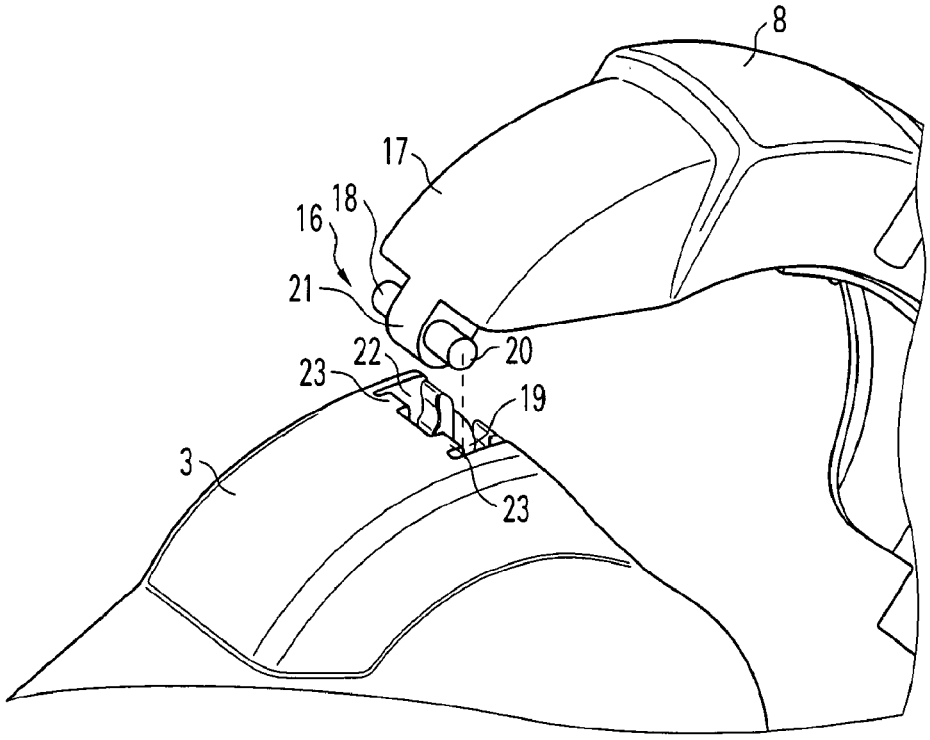
FIG. 5 shows a perspective view of the locking mechanism.

FIG. 5 shows a perspective view of the locking mechanism 16. The second end 17 of the flap 8 is provided with a locking member 18 of the locking mechanism 16 which is adapted to engage with a locking portion 19 of the locking mechanism 16 provided at a corresponding position in the second housing member 3. The locking member 18 is composed of an axle 20 running substantially perpendicular through a lug 21 projecting from the second end 17 of the flap 8.

To close the locking mechanism 16, the locking member 18 has to be pushed into an opening 22 provided in the surface of the second housing member 3, whereby two projections 23 partly covering the opening 22 elastically fold down to let the locking member 16 pass into the opening 22 and elastically fold back afterwards to cover the two portions of the axle 20 projecting on either side of the lug 21. Thus, the flap 8 is locked in the closed position.

Figure 6:
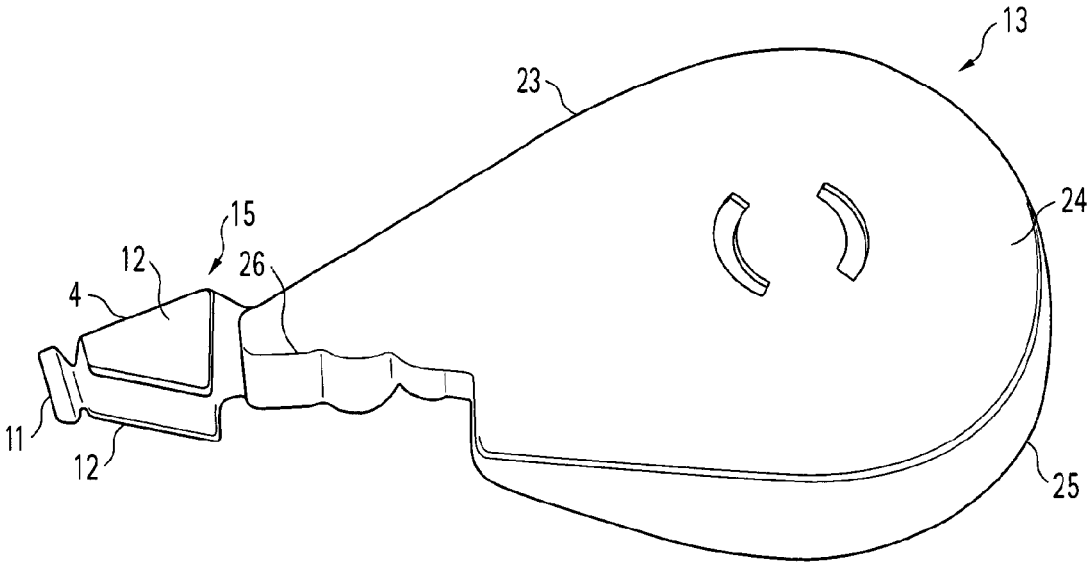
FIG. 6 shows a side view of a replaceable cartridge according to an embodiment of the present invention.

FIG. 6 shows a side view of a replaceable cartridge 13 according to an embodiment of the present invention. The cartridge 13 has a housing 23 which is composed of an upper body 24 and a lower body 25 which are connected to each other. The housing 23 also has a tip opening 26 through which the application member 5 extends around which a correction tape or the like can be guided. The application member 5 has a tip 4 on the sides of which respective guiding wings 12 are mounted and an application edge 11. In the cavity formed in the interior of the housing 23, a supply and driving mechanism is provided.

Figure 7:
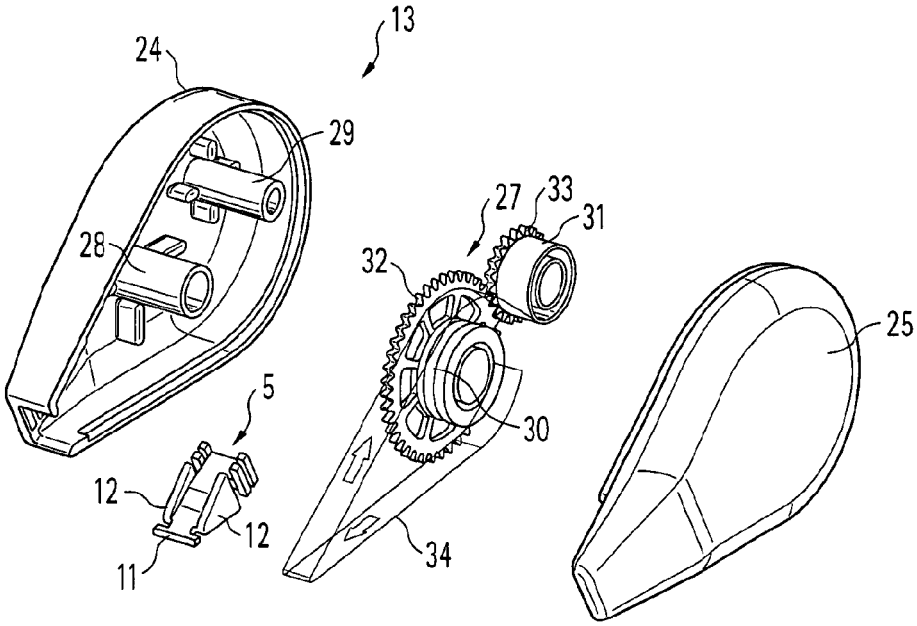
FIG. 7 shows an exploded view through a replaceable cartridge according to an embodiment of the present invention.

FIG. 7 shows an exploded view of a replaceable cartridge according to an embodiment of the present invention. The upper body 24 and the lower body 25 are shown in a disassembled state here. Moreover, the application member 5 and the driving mechanism 27 are shown as separate components. On an inner wall of the upper body 24, a supply reel axle boss 28 and a take-up reel axle boss 29 are formed. These components can just as well be formed on the inner wall of the lower body 25. Here, the supply reel axle boss 28 and the take-up reel axle boss 29 are spaced apart from each other to separately receive the supply reel 30/drive gear wheel 32 and the take-up reel 31/driven gear wheel 33. However, also a coaxial arrangement of the latter is just as well conceivable.

In the assembled state, the supply reel 30 and drive gear wheel 32 are mounted on the supply-reel axle boss 28 and the take-up reel 31 and the driven gear wheel 33 are mounted on the take-up reel axle boss 29. The driving mechanism 27 has an integrated frictional clutch functioning to unwind a correction tape 34 or the like from the supply reel 30 and to wind the used correction tape 34 onto the take-up reel 31.

As already mentioned above, any other driving mechanism can also be provided within the cartridge 13 as well. Moreover, the cartridge 13 can be filled with different kinds of tapes. As long as the cartridge 13 has the same shape and size, it will always fit into the second housing 3, such that the hand-held device 1 can also be reused for different purposes.

LIST OF REFERENCE NUMERALS

1 hand-held device
2 first housing member
3 second housing member
4 tip
5 application member
6 tip opening
7 front end
8 flap
9 rear end
10 rear opening
11 application edge
12 guiding wings
13 cartridge
14 tip opening
15 hinge
16 locking mechanism
17 second end
18 locking member
19 locking portion
20 axle
21 lug
22 opening
23 housing
24 upper body
25 lower body
26 tip opening
27 driving mechanism
28 supply reel axle boss
29 take-up reel axle boss
30 supply reel
31 take-up reel
32 drive gear
33 driven gear
34 tape
35 first end
L longitudinal axis

The invention claimed is:

1. A hand-held device for transferring a film of material from a backing tape onto a substrate, comprising:

a housing including a first housing member and a second housing member, as well as an application member around which the tape is guided and which is designed to be pressed against a substrate in order to transfer the film, as well as at least two reels being arranged coaxially with each other onto the which the backing tape is wound, wherein the first and second housing member are mounted telescopically with each other such that in an extended position the first housing member covers the application member and in a pushed-back position the application member is exposed for usage, wherein the first housing member overlaps the second housing member such that the rear end of the first housing member overlaps at least a part of a contour of at least one reel when viewed from a side view, wherein the first housing member overlaps the second housing member rearwards at least up to the common axis of the two reels when disposed in the pushed back position when viewed from a side view, wherein the second housing member, in the interior of which the two reels are mounted, has a shape of a disc when viewed from a side view, and wherein the rear end of the first housing member only covers the side walls of the second housing member.

2. The hand-held device according to claim 1, further comprising: a replaceable cartridge, the first housing member being provided with a tip opening at a front end of the hand-held device, and the second housing member being provided with a rear opening and a flap at a rear end of the hand-held device, the flap being adapted to swing around an axis of a hinge from a closed position, in which it covers the rear opening, to an open position in which it uncovers the rear opening.

3. The hand-held device according to claim 2, wherein the flap has a first end which is hinged to the second housing member.

4. The hand-held device according to claim 3, wherein the flap has a second end, which is provided with a locking member adapted to engage with a corresponding locking portion provided in the second housing member.

5. The hand-held device according to claim 2, wherein the cartridge comprises a supply reel axle boss on which a supply reel is mounted, on which the backing tape with the film thereon is wound.

6. The hand-held device according to claim 2, wherein the cartridge comprises a take-up reel axle boss onto which a take-up reel is mounted, onto which the used backing tape is wound automatically.

7. The hand-held device according to claim 2, wherein the cartridge comprises an application member, around which the backing tape is guided, comprising a tip having an application edge.

8. The hand-held device according to claim 2, wherein a driving mechanism for supplying the backing tape comprises a frictional clutch.

9. The hand-held device according to claim 1, wherein the first housing member and the second housing member can be moved relative to each along a longitudinal axis (L) of the hand-held device from a first position in which the tip of the application member protruded through the tip opening to a second position in which the tip of the application member is retracted into the housing.

10. The hand-held device according to claim 9, wherein in the second position, the second housing member is extended.

11. The hand-held device according to claim 2, wherein the flap has a semicircular shape corresponding to the rear end of the second housing member.

12. The hand-held device according to claim 2, wherein the rear opening has a size which is slightly larger than the size of the cartridge.

13. The hand-held device according to claim 2, wherein the cartridge is supported in the second housing member.

14. The hand-held device according to claim 2, further comprising the replaceable cartridge for refilling the hand-held device with the backing tape on which a film of material is applied, the replaceable cartridge comprising a housing provided the tip opening through which the application member, around which the tape is wound, protrudes, and a driving mechanism.

15. The hand-held device according to claim 14, wherein a supply reel axle boss is formed on an inner wall of the housing, on which a supply reel is mounted, on which the backing tape with the film thereon is wound.

16. The hand-held device according to claim 15, wherein a take-up reel axle boss is provided on an inner wall of the housing, on which a take-up reel is mounted, onto which the used backing tape is wound automatically.

17. The hand-held device according to claim 16, wherein a driving mechanism is provided, wherein a drive gear wheel is provided on the supply reel axle boss and a driven gear wheel is provided on the take-up reel axle boss.

18. The hand-held device according to claim 16, wherein the drive gear wheel and the driven gear wheel are in engagement.

19. The hand-held device according to claim 17, wherein the driving mechanism comprises a frictional clutch.

20. The hand-held device according to claim 19, wherein the housing of the replaceable cartridge comprises an upper body and a lower body.

21. The hand-held device according to claim 1, wherein the first housing member overlaps the second housing member at least up to the bearing axis of the reels.

* * * * *